United States Patent [19]

Rogers et al.

[11] Patent Number: 4,529,928

[45] Date of Patent: Jul. 16, 1985

[54] AUTOMATIC CONTROL CIRCUIT FOR A CURRENT TRANSLATING DEVICE

[75] Inventors: Jerrold J. Rogers, Beaverton; Judd L. Sirotiak, Tualatin, both of Oreg.

[73] Assignee: Tektronix, Inc., Beaverton, Oreg.

[21] Appl. No.: 496,694

[22] Filed: May 20, 1983

[51] Int. Cl.[3] ..... G05F 1/44

[52] U.S. Cl. ..... 323/280; 323/902

[58] Field of Search ..... 323/273-277, 323/280, 312, 315-316, 902

[56] References Cited

U.S. PATENT DOCUMENTS 4,251,743 2/1981 Hareyama ..... 323/273 X
4,280,091 7/1981 Hiltner ..... 323/315

OTHER PUBLICATIONS

Hyland, R. N., "Constant Current Circuit", IBM Technical Disclosure Bulletin, vol. 13, No. 8, Jan. 1971, pp. 2367-2368.

Beistle, R. G., "Noise-Rejecting Phototransistor Circuits in Optical-Sensing Applications", IBM Technical Discl. Bulletin, vol. 19, No. 8, Jan. 1977, pp. 2903-2904.

Gianos, P. T., "Threshold Detector for Optical Transducers", IBM Tech. Discl. Bulletin, vol. 19, No. 10, Mar. 1977, pp. 3661-3662.

*Primary Examiner*—Peter S. Wong

*Attorney, Agent, or Firm*—Robert S. Hulse; Francis I. Gray

[57] ABSTRACT

A circuit is described for automatically controlling an input current to a current translating device having an output current functionally related to the input current. A sensing circuit detects the output current of the device and produces a control signal representative of the output current. The control signal is coupled to a control circuit that varies the input current to the device. In the preferred embodiment of the invention, the dynamic range of the sensing circuit is increased by coupling a constant current generator to its input.

11 Claims, 4 Drawing Figures

AUTOMATIC CONTROL CIRCUIT FOR A CURRENT TRANSLATING DEVICE

BACKGROUND OF THE INVENTION

The present invention relates to an electrical circuit for automatically controlling an input current to a current translating device having an output current functionally related to the input current.

Current translating devices, such as current mirrors, current transducers, opto-couplers, and the like, produce an output current that is functionally related to an input current. The functional relationship between the input and output currents of these devices can be defined as a current-transfer ratio wherein a given amount of input current produces a proportional amount of output current. Knowing the current-transfer ratio for a particular type of current translating device permits the design of control circuits that establish the input current level and correspondingly the output current level for the device. However, the current-transfer ratios of similar types of devices can vary over a wide range due to variation in the electrical characteristics of the individual elements making up the device. Additionally, the current-transfer ratio of a given device can vary over time due to changes in temperature, degradation of the device, and so forth. Further, it is desirable in some applications to controllably change the current-transfer ratio of a device to produce a variable current output.

An opto-coupler is an example of a current translating device that exhibits the above described characteristics. An opto-coupler is generally composed of a light source, such as a light-emitting diode (LED), and an opto-receiver, such as a phototransistor. The current input to the LED produces a radiating light output from the LED that is coupled to the phototransistor. A current output is produced by the phototransistor in response to the light intensity from the LED which is controlled by its current input. As previously stated, the individual components of a current-translating device, in this case an optocoupler, have a wide range of electrical characteristics which results in a wide range of current-transfer ratios. It is for this reason that an adjustable control circuit is required for establishing the input current level to the opto-coupler based on its current-transfer ratio. In addition, the current-transfer ratio of the opto-coupler can change if foreign material collects on the LED or the phototransistor and diffuses the light.

A circuit is needed for use with a current translating device having a wide range of current transfer ratios that automatically controls the input current to the device so that the proper, functionally related output current is produced.

SUMMARY OF THE INVENTION

The present invention is directed toward an electrical circuit for automatically controlling an input current to a current translating device having an output current functionally related to an input current. The current output of the current translating device is coupled to a sensing circuit, such as a current-to-voltage converter, that detects the output current from the device and produces a control voltage representative of the output current. The control voltage is coupled to a control circuit, such as a current-steering network, that establishes the input current level to the current-translating device. In the preferred embodiment of the present invention, a current generator is coupled to the output of the current translating device to increase the dynamic range of the control voltage.

A more complete understanding of the present invention and its various features, advantages, and objectives may be had by referring to the following detailed description and the accompanying drawings.

DETAILED DESCRIPTION

Figure 1:
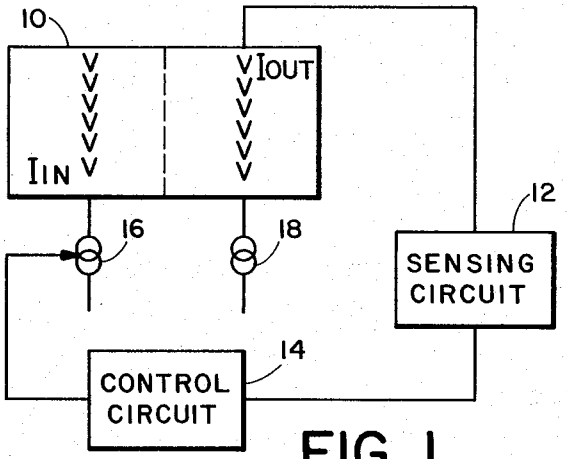
FIG. 1 is a block diagram of the automatic control circuit for a current translating device of the present invention.

Referring now to FIG. 1, there is shown a block diagram of the automatic control circuit for a current translating device 10, examples of which include current mirrors, current transducers, and optocouplers. These devices produce an output current, $I_{out}$, that is functionally related to an input current, $I_{in}$, in accordance with a so-called current-transfer ratio. A sensing circuit 12 is coupled to monitor the output current, and produces a voltage control signal in response to a detected sample thereof. The voltage control signal is coupled to a control circuit 14 that establishes the $I_{in}$ current level, represented by current generator 16, to the current translating device 10. Production of output current is represented by current generator 18.

When the current-transfer ratio of the current translating device 10 is constant, equilibrium (or balance) is established in the circuit due to sensing circuit 12 providing a level of control to control circuit 14, which establishes a level of input current to device 10, that controls the output current according to the current-transfer to ratio of device 10. Any change in the $I_{out}$ current from the device 10 is detected by sensing circuit 12, which in turn produces a change in voltage control signal. The change in the voltage control signal is coupled to the control circuit which changes the input current to device 10.

If the current-transfer ratio of device 10 should change, for example due to changes in the temperature, degradation of the device, and so forth, then the input current level to device 10 will change accordingly until the output current level of the device 10 is set at a new level which stabilizes the voltage control signal of sensing circuit 12, thereby reestablishing equilibrium in the circuit.

It is desirable in some circuit applications to controllably change the current-transfer ratio of device 10 to vary the $I_{out}$ current of device 10. The $I_{in}$ current to device 10 is correspondingly changed in response to the detected changes in the $I_{out}$ current in an attempt to set the $I_{out}$ current at a level that reestablishes equilibrium in the circuit. So long as the current-transfer ratio of device 10 is changing, the circuit is not in equilibrium and the $I_{in}$ current to current translating device 10 will attempt to set the $I_{out}$ current at a level to reestablish equilibrium. The FIG. 2 through FIG. 4 circuit embodiments of the present invention, which employ the principles hereinabove described, produce a variable output signal for detecting the velocity of a movable recording medium in a recording apparatus.

Figure 2:
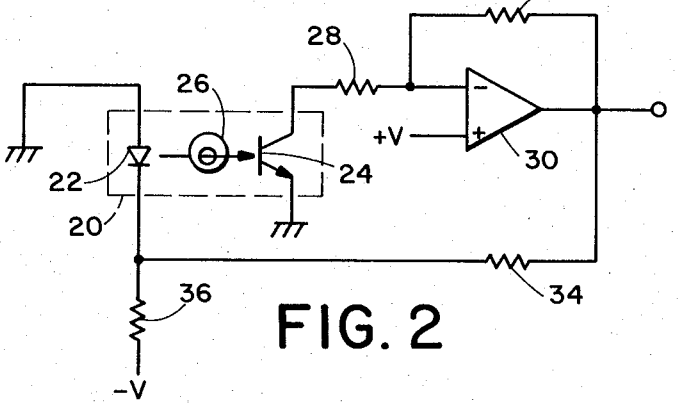
FIG. 2 is a detailed schematic of one embodiment of the automatic control circuit for a current translating device in accordance with the present invention.

Referring to FIG. 2, there is shown one embodiment of the automatic control circuit for a current translating device where the device is an opto-coupler 20. The opto-coupler 20 has a light-generating source 22, shown in the figure as a light emitting diode (LED), and a light-sensitive receiver 24, shown as a phototransistor. Interposed between LED 22 and phototransistor 24 is a light interrupter 26, the function of which is described in greater detail below. LED 22 and phototransistor 24 may be packaged into a single device, called an opto-sensor, that has an opening for light interrupter 26. Devices of this type are commercially available.

The collector of phototransistor 24 is coupled to the inverting (−) input of operational amplifier, hereinafter abbreviated "op amp", 30 via isolating resistor 28. The non-inverting (+) input of op amp 30 is coupled to a reference voltage +V. The output terminal of op amp 30 is coupled to the inverting input of the op amp via a feedback resistor 32. The output terminal of op amp 30 is also coupled to the current supply end of LED 22 via resistor 34. Resistor 36 is also coupled to the current supply end of LED 22 and to a negative voltage potential −V to provide a fixed portion of the current input to LED 22.

The circuit operates in the following manner. The current input level to LED 22 is established by the fixed current portion flowing through resistor 36 and the variable current portion flowing through resistor 34. Current flowing through LED 22 produces a corresponding light output that is coupled to phototransistor 24. A current is produced through phototransistor 24 in response to the intensity of the light from LED 22 and the current-transfer ratio of opto-coupler 20. The current output of phototransistor 24 is coupled through isolating resistor 28 to the inverting input of op amp 30 which acts to maintain the same voltage at both inputs. A current flow is produced through feedback resistor 32 to balance the current through isolating resistor 28 in response to current at the inverting input of op amp 30. The current flow through resistor 32 produces a voltage control signal at the output terminal of op amp 30 that is higher than the null point voltage, +V, on the inverting input of the op amp. The voltage control signal on the output terminal of op amp 30 produces a current through resistor 34 that controls the input current level to LED 22.

As the voltage on the op amp 30 output terminal end of the resistor 34 is increased in a positive direction, a greater portion of the fixed current through resistor 36 is supplied by resistor 34. This decreases the current through LED 22 which in turn decreases the light intensity of the LED. This causes a decrease in the current flowing through phototransistor 24 which causes less current to flow through resistor 32 thereby decreasing the voltage at the output of op amp 30. An equilibrium point is reached where the output of op amp 30 is stable.

One drawback to the above described circuit is the limited range of the voltage on the output terminal of op amp 30 which controls the current to LED 22. Additionally, care must be taken in selecting resistor values so as not to cause the cutoff and reverse biasing of LED 22. These drawbacks can be eliminated by adding a current generator to the circuit.

Figure 3:
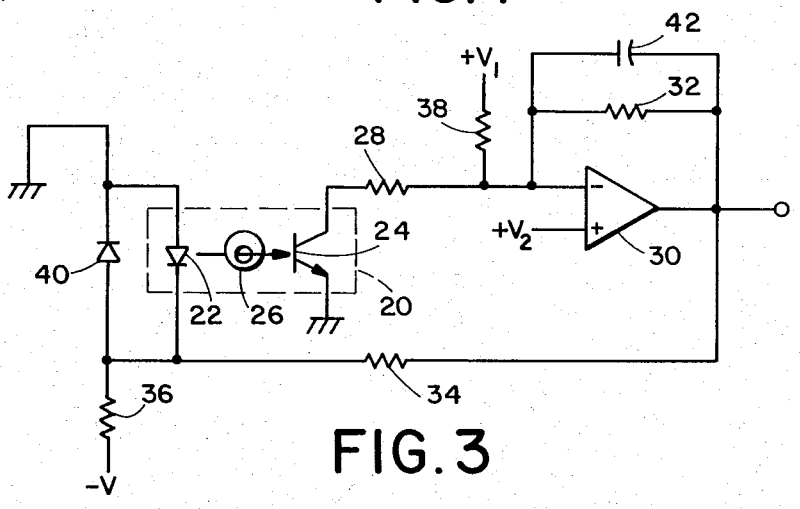
FIG. 3 is a detailed schematic of a second embodiment of the present invention.

Referring to FIG. 3, there is shown a second embodiment of the automatic control circuit for a current translating device of the present invention. Like elements in FIG. 3 are labeled the same as in FIG. 2, keeping in mind that the values of the resistors in FIG. 3 may be different. The main difference between the circuit of FIG. 3 and the circuit of FIG. 2 is the addition of a current generator, in the form of resistor 38, coupled between the inverting input of op amp 30 and a positive voltage source, $+V_1$. It should be noted that for proper operation of the circuit the voltage potential, $+V_1$, must be greater than the voltage potential, $+V_2$, on the non-inverting input of op amp 30. FIG. 3 also shows an optional protection diode 40 and an optional stabilization capacitor 42.

The operation of the circuit in FIG. 3 varies from the operation of the circuit in FIG. 2 in that the current through feedback resistor 32 is determined by the difference between the currents through resistor 38 and phototransistor 24. For example, if the current through pbototransistor 24 is 2.5 ma and the current through resistor 38 is 2.0 ma, then there is 0.5 ma of current through resistor 32 to the null point of op amp 30. This increases the voltage in the output terminal of op amp 30 to cause the circuit corrections previously described.

In the case where there is no current through phototransistor 24, all of the current flowing through resistor 38 will flow through resistor 32. This causes the voltage on the output of op amp 30 to increase sharply in a negative direction. This is a departure from the circuit operation of FIG. 2 where the voltage on the output of op amp 30 could only decrease to the level of the null point voltage.

Figure 4:
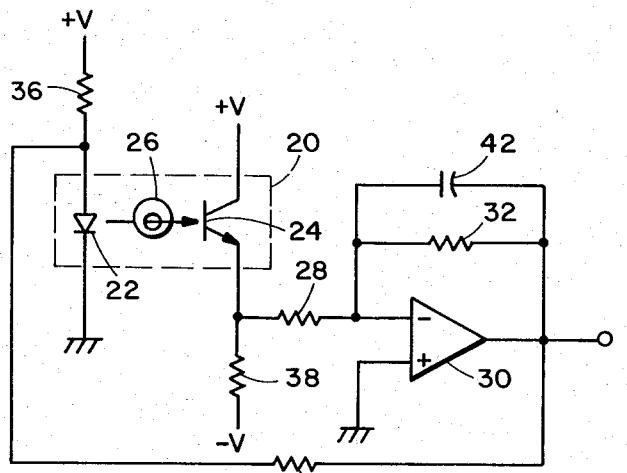
FIG. 4 is a detailed schematic of a third embodiment of the present invention.

Referring now to FIG. 4, there is shown an alternate embodiment of the circuit of FIG. 3. The like elements in FIG. 4 are labeled the same as those elements in FIG. 3. The main difference between the circuit of FIG. 4 and the circuit of FIG. 3 is that the current output of opto-coupler 20 is taken from the emitter circuit of phototransistor 24. This produces an opposite effect on the voltage at the output of op amp 30. As the current through phototransistor 24 increases, the voltage at the output of op amp 30 increases in a negative direction. This requires that the control circuit for establishing the input current to LED 22 be coupled to a positive voltage source, +V, and resistors 34 and 36 be coupled to the anode of LED 22.

As previously mentioned, the embodiments shown in FIGS. 2, 3, and 4 are suitable for use in detecting the velocity of a movable recording medium in a recording apparatus. As shown in FIGS. 2, 3, and 4, a light interrupter 26 is interposed between LED 22 and phototransistor 24. The light interrupter 26, which may suitably be a slotted disk attached to a drive-roller portion of the recording apparatus, periodically blocks the light from LED 22 to phototransistor 24 causing the current output of phototransistor 24 to increase and decrease. The light interrupter 26 is effectively a device for changing the current-transfer ratio of opto-coupler 20. This change in the output current is detected by op amp 30 and a varying voltage corresponding to the changes in the output current of phototransistor 24 is produced at the output terminal of op amp 30 and coupled to resistor 34 to vary the input current to LED 22 based on the changing current-transfer ratio of opto-coupler 20. The voltage on the output of op amp 30 is also coupled as an output signal to other circuits within the recording apparatus. Since light interrupter 26 is mechanically coupled to a recording medium drive roller, the output signal frequency is proportional to the velocity of the movable recording medium.

The terms and expressions which have been used in the foregoing specification are used therein as terms of description and not of limitation, and there is no intention, in the use of such expressions, of excluding equivalents of the features shown and described or portions thereof, it being recognized that the scope of the invention is defined and limited only by the claims which follows.

We claim:

1. A circuit for automatically controlling an opto-coupler having an output current functionally related to an input current, the circuit comprising:

means for sensing the level of said output current and for generating a control signal;

means for generating a fixed current portion of said input current; and means responsive to said control signal for generating a variable current portion of said input current.

2. A circuit as recited in claim 1 wherein said fixed current portion generating means comprises a first resistive device coupled between the input of said opto-coupler and a voltage source.

3. A circuit as recited in claim 2 wherein said variable current portion generating means comprises a second resistive device coupled between the output of said sensing means and the input of said opto-coupler such that said control signal varies said input current.

4. A circuit in accordance with claim 3 wherein said sensing means is a current-to-voltage converter.

5. A circuit in accordance with claim 4 wherein said current-to-voltage converter comprises an operational amplifier having a feedback resistor coupled from its output terminal to its inverting input terminal and a reference potential coupled to its non-inverting input terminal.

6. A circuit as recited in claim 1 further comprising a current generator coupled to the input of said sensing means so that said control signal is increased by the difference between the current from said current generator and said output current.

7. A circuit as recited in claim 6 wherein said fixed current portion generating means comprises a first resistive device coupled between the input of said opto-coupler and a voltage source.

8. A circuit as recited in claim 7 wherein said variable current portion generating means comprises a second resistive device coupled between the output of said sensing means and the input of said opto-coupler such that said control signals varies said input current.

9. A circuit in accordance with claim 8 wherein said current generator comprises a third resistive device coupled between a first and second voltage source so as to produce a constant current therethrough.

10. A circuit in accordance with claim 9 wherein said sensing means is a current-to-voltage converter.

11. A circuit in accordance with claim 10 wherein said current-to-voltage converter comprises an operation amplifier having a feedback resistor coupled between its output terminal and its inverting input terminal and a reference potential coupled to its non-inverting input terminal.

* * * * *